United States Patent [19]

Progar

[11] 4,420,518

[45] Dec. 13, 1983

[54] HOT MELT RECHARGE SYSTEM

[75] Inventor: Donald J. Progar, Yorktown, Va.

[73] Assignee: The United States of America as represented by the Administrator of the National Aeronautics and Space Administration, Washington, D.C.

[21] Appl. No.: 361,215

[22] Filed: Mar. 24, 1982

[51] Int. Cl.[3] ..... B32B 7/02; C09J 7/00

[52] U.S. Cl. ..... 428/40; 428/78; 428/202; 428/347; 206/447; 206/582

[58] Field of Search ..... 428/40, 78, 76, 200, 428/202, 347, 41, 42; 427/208.2; 206/582, 441, 447

[56] References Cited

U.S. PATENT DOCUMENTS 2,940,884 6/1960 White ..... 428/41

2,975,091 3/1961 Tobey ..... 428/347 X 3,881,041 4/1975 Glienke ..... 428/40

*Primary Examiner*—Alexander S. Thomas

*Attorney, Agent, or Firm*—Howard J. Osborn; John R. Manning; Wallace J. Nelson

[57] ABSTRACT

A package assembly for precisely positioning a charge of hot melt adhesive 37 onto an attachment pad (13, 15, 17) or point of use wherein the adhesive is heated to softening or melt temperature (280° F.-325° F.) and thereafter cooled to resolidifying temperature. A single sided pressure sensitive polyimide film tape 40 serves with another film strip 39 to protect sandwiched adhesive strip 37 until use and to hold the adhesive in precise position until thermally bonded to its point of use. Tab ends 39' and 40' serve as aids in stripping tapes 39 and 40, respectively, from the adhesive charge 37.

6 Claims, 3 Drawing Figures

HOT MELT RECHARGE SYSTEM

ORIGIN OF THE INVENTION

The invention described herein was made by a Government employee and may be manufactured and used by or for the Government for governmental purposes without the payment of any royalties thereon or therefor.

BACKGROUND OF THE INVENTION

The successful operation of the Space Shuttle program currently operated by the National Aeronautics and Space Administration has been aided by detailed preparation in anticipation of possible causes of failure and providing corrective avenues in the eventuality of any foreseeable problems. One such provision is the development of repair techniques for replacing of damaged or lost HRSI tiles by the astronauts during the orbital portion of a space mission. A Surface Attachment Assembly (SAA) has been developed for this purpose and is the subject matter of NASA Invention Disclosure No. LAR 12894-1 entitled "Hot Melt Adhesive Attachment Pad" and made by the present inventor, and others, and filed in the U.S. Pat. Office, Ser. No. 516,087, on July 22, 1983. This system utilizes a Shuttle Work Restraint Unit (SWRU) consisting of a scaffolding or platform releasably attached to the vehicle exterior, i.e., to the thermal protective tiles or other areas of the vehicle to permit extra vehicular work by the astronaut. This work restraint unit permits more freedom of movement by the astronauts in making repairs to the vehicular exterior or for other work requiring the use of both hands. The work restraint unit is provided with one or more surface attachment assembly pads that serve as the releasably attached contact points for the work restraint unit. In the embodiment to be described herein one pad unit consists of three surface contact pads attached to the work restraint unit and serving as a releasably attachment for the unit with the vehicle surface. Thus, by securing the work restraint unit to a particular segment of the vehicle exterior via the releasably surface contact pads, needed work on the vehicle at a specific location may be conducted and when completed the releasable contacts moved to a different area of the vehicle. Thermoplastic adhesives that soften at controlled elevated temperatures and resoldify when the temperatures are decreased have proved of adequate strength for these purposes. By providing heating and cooling mechanisms in the surface attachment pad faces, a charge of hot melt thermoplastic adhesive provided on the pad surface is heated and cooled selectively to provide the attachment and release of the work restraint unit at the control of the astronaut operator. One problem that has arisen in the use of this attachment-release mechanism however, is that the hot melt adhesive charge is depleted after a number of attachment-release sequences and the attachment must be recharged with additional adhesive. Problems arising in accomplishing this recharge load process under the adverse spatial vacuum conditions has led to the present invention.

It is therefore an object of the present invention to provide an article of manufacture that permits accurate positioning of hot melt type adhesive.

Another object of the present invention is to provide a process for recharging a hot melt adhesive to an attachment pad.

A further object of the present invention is an article for protectively packaging individual hot melt adhesive charges until ready for use.

An additional object of the present invention is a recharge assembly for a hot melt adhesive attachment pad.

According to the present invention, the foregoing and additional objects are attained by providing a charge or film of hot melt thermoplastic adhesive sandwiched between two layers or sheets of protective film strips that extend beyond the film of hot melt adhesive. At least one of the film strips is provided with a pressure sensitive adhesive coating to adhere to the film of hot melt adhesive and the other film strip to form the sandwich. Suitable non-adhering tab ends are provided on each end of both film strips to facilitate separation of the film strips and expose a surface of the hot melts adhesive. For use, this exposed surface of adhesive is disposed abutting a surface attachment pad and retained in position thereon by the remaining pressure sensitive film strip while heated to the melt or softening temperature of hot melt adhesive. The adhesive is then cooled to solidifying temperature and, thus, becomes permanently affixed to the surface attachment pad. Upon each attachment/release of the surface attachment pad some of the hot melt adhesive charge is lost and after a number of such uses the charge must be replaced. The recharging process is difficult to perform under the adverse spatial vacuum conditions without the use of the present invention.

BRIEF DESCRIPTION OF THE DRAWINGS

A more complete appreciation of the invention and many of the attendant advantages thereof will be readily apparent as the same becomes better understood by reference to the following description when considered in connection with the accompanying drawings wherein.

DETAILED DESCRIPTION OF THE INVENTION

Figure 1:
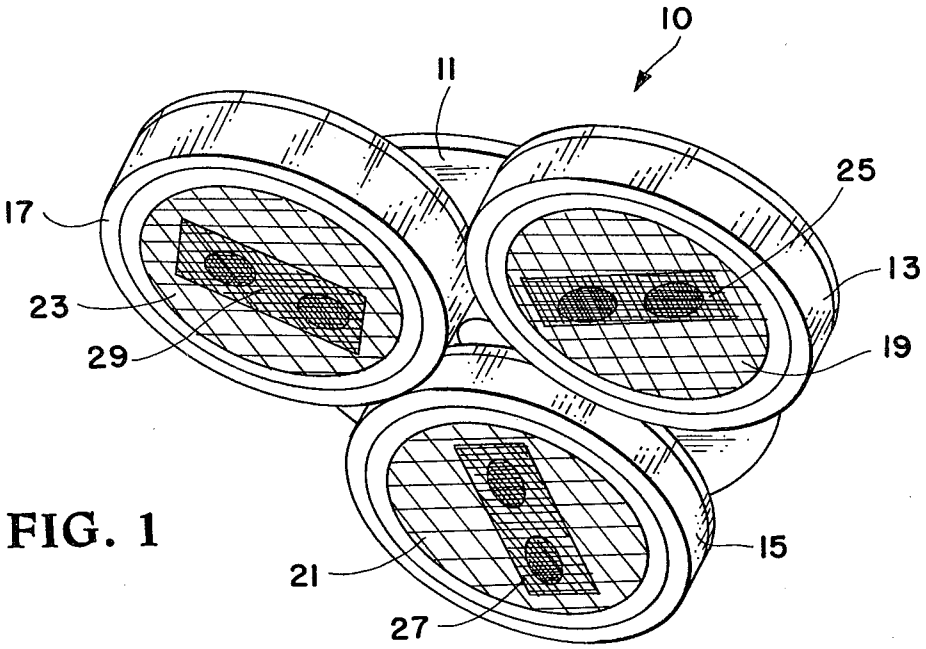
FIG. 1 is a view, with parts omitted, of a surface attachment pad assembly that utilizes the present invention.

Referring now to FIG. 1, there is illustrated a surface attachment pad assembly generally designated by reference numeral 10. Assembly 10 is one of several such attachment structures employed to releasably retain a work restraint unit (not shown) on the exterior of a space vehicle such as, for example, the Shuttle Orbiter, to permit an astronaut to make repairs or conduct other extra vehicular work requiring the use of both hands. A plurality of such assemblies 10 are suitably secured to and employed to releasably retain the work restraint unit in operative position on the vehicle exterior surface when such unit is needed by the astronaut. Base plate 11 serves as the connection between assembly 10 and the work restrain unit (not illustrated) with such attachment being fixed or adjustably movable as so desired. In the specific embodiment chosen for illustration herein, assembly 10 includes three attachment pads as designated by reference numerals 13, 15, and 17. Each pad surface is constructed of a suitable fiberglass or equivalent reinforced cloth, as designated, respectively, by reference numerals 19, 21 and 23. Each of these cloth face surfaces is provided with a holt melt thermoplastic adhesive charge as designated, respectively, by reference numerals 25, 27 and 29. Individual heater-cooler mechanisms (not shown) are provided in the attachment pad bodies with controls (also not shown) selectively activated by the astronaut operator for selectively heating the adhesive charges 25, 27 and 29 to softening or melt temperature. After positioning the attachment pad assembly such that individual pads 13, 15 and 17 contact the exterior vehicle surface, the cooling phase is activated to reduce the adhesive and pad temperatures adequately to cause adhesive charges 25, 27 and 29 to again solidify and thereby adhere the surface attachment pad assembly and its secured work control unit to the vehicle surface. Similarly, when it is desired to remove or relocate the work control unit, the pad assemblies are again heated to soften the adhesive charges sufficiently for release thereof. Some of the adhesive invariably remains on the vehicle surface and after a number of heating and cooling cycles the adhesive charges 25, 27 and 29 must be replenished. This recharging process is difficult in the spatial vacuum environment and is simplified by use of the present invention.

Figure 2:
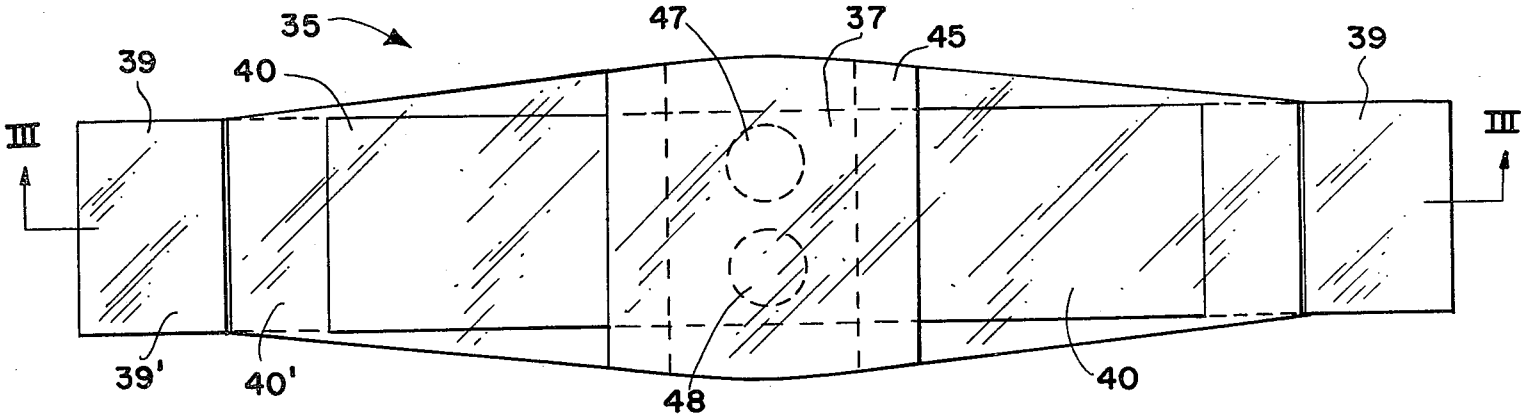
FIG. 2 is a top view of hot melt adhesive package according to the present invention and utilized to recharge the surface attachment pads shown in FIG. 1.
Figure 3:
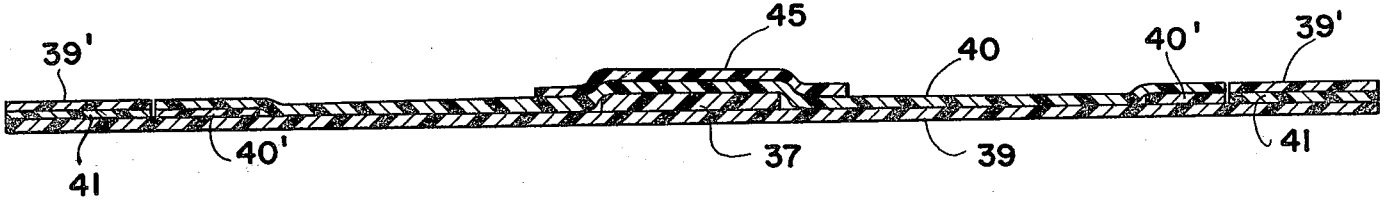
FIG. 3 is a sectional view of the hot melt adhesive package taken along line III—III of FIG. 2.

Referring now more particularly to FIGS. 2 and 3 a recharge hot melt adhesive package according to the present invention is shown and designated generally by reference numeral 35. This package 35 includes a film or strip of solidified hot melt adhesive 37 sandwiched between two layers of protective film strips designated by reference numerals 39 and 40. In the specific embodiment described herein, film strip 39 was a five mil film of Teflon (polytetrafluroethylene) Type C, and film strip 40 was a pressure sensitive polyimide film tape (Kapton Tape No. 2345-2) purchased from Dodge Fluoroglas Division. The specific hot melt adhesive film employed was a 3 M Company product Jetmelt 3746 having a softening temperature in the range of 280° F.–325° F.

Each of film strips 39 and 40 is provided with non-adhering reinforced end tabs as designated, respectively, by reference numerals 39' and 40'. Tabs 39' and 40' are both formed of five mil Teflon film and attached as shown to the ends of films 39 and 40. Tab 39' is attached to film 39 by a suitable pressure sensitive adhesive 41 (e.g., Permacel EE-6962, a double faced one-mil thick Kapton backed film) while tab 40' is attached directly to the pressure sensitive adhesive side of film 40.

In the specific embodiment illustrated an additional protective film sheet 45 is provided on the exterior surface of film strip 40 at least of a length sufficient to span the width of hot melt adhesive film 37. Protective film 45 is constructed of the same polyimide pressure sensitive tape as film strip 40 in the preferred embodiment. This additional film sheet may be omitted when the adhesive charge is small enough to be adequately covered by the film strip 40.

Suitable apertures 47 and 48 are provided through adhesive film 37 to conform to cold spots in the heater assembly of the respective pads.

The operation of the invention is now believed apparent. When it is necessary to recharge any of attachement pads 13, 15 or 17 with adhesive, an adhesive package 35 is employed. Protective film strip 39 is grasped by the reinforced tabs 39' thereon and peeled from contact with strip 40 to expose a surface of the hot melt adhesive charge 37. The pressure sensitive film strip 40 is then precisely positioned to place hot melt charge 37 over the heater/cooler element of the pad and attached to the face (19, 21 or 23) of an individual pad (13, 15 and 17) with the exposed face of adhesive charge 37 abutting the pad face. The pressure sensitive film strip 40 is pressed down on the rim of the pad and the glass cloth face thereof to maintain adhesive charge 37 in position. The heating mechanism within the pad is then activated to heat adhesive 37 to softening or melt temperature (280° F.–325° F.) and retained at that temperature for a short period of time adequate (approximately two minutes) for the adhesive to make permanent adherence to the cloth face. Heat is terminated and the pad cooler element is activated to effect cooling of the pad face to 150° F.–180° F. This temperature range is adequate or "safe" for the loads that the present system was designed to carry but could vary for other applications. Protective film strip 40 along with attached supplemental film strip 45 is then peeled away by grasping tabs 40' from adhesive film 37 and the surface attachment assembly is again ready for use for releasably securing the pad and connected work restraint unit on the vehicle exterior. The hot melt adhesive employed in the specific example described herein is a 0.02 inch thick polyamide film supplied under the tradename, Jetmelt 3746 by the 3 M Company. Other hot melt thermoplastic materials that are suitable for practice of the present invention include any hot melt adhesive that does not deteriorate under spatial vacuum conditions and softens within the heater/cooler temperature range of the individual pads such as Polyshot 804, a product of Ornsteen Chemicals, Inc.

The use of the pressure sensitive adhesive film strips to protect the hot melt adhesive charge prior to use also has other advantageous features. The hot melt charge is not tacky prior to being heated to melt temperature and must be held in place by some method during a recharge operation or it would float away in the vacuum of space. Thus, the pressure sensitive adhesive film 40 serves to hold the recharge 37 in precise position on the pad face and over the pad heater until it is fused to the recharge pad surface face. Without this recharge capability, the surface attachment assembly pads would be limited to the number of attachments-detachments that could be performed with the initial charge only. Any attempts by an astronaut to apply the hot melt adhesive to a heated surface would be extremely difficult and could be disasterous since contacting the melted adhesive would cause it to stick immediately and adhere to the person.

Although the invention has been described relative to space applications, it is not so limited. For example, in Earth applications, any difficult location such as a fixed inverted position when it is desired to employ hot melt adhesive as an initial charge or recharge application, the present invention would prove valuable. The dimensional configurations described herein are given for the specific example and utilization for three inch diameter glass cloth pads of the surface attachment assembly anticipated for use on the current Space Orbiter vehicle. This specific example has proved adequate attachment for releasably securing the work restraint unit to exterior areas of this vehicle including direct attachment to the thermal protective tiles (HRSl Shuttle tiles). Other configurations and dimensions for the hot melt adhesive and package are considered within the scope of the present invention as the specific application therefor may dictate.

Thus, the invention may be practiced other than as specifically described in reference to the detailed embodiment given herein. Accordingly, although the invention has been described relative to specific embodiments thereof, it is not so limited and numerous variations and modifications will be readily apparent to those skilled in the art in light of the above teachings. It is therefore to be understood that within the scope of the appended claims the invention may be practiced other than as specifically described.

What is claimed as new and desired to be secured by Letters Patent of the United States is:

1. An article of manufacture comprising in combination with a strip of hot melt adhesive composition, means for positioning and utilizing said strip of solid hot melt adhesive at a point of use therefor;

said means including a first protective sheet in contact with one surface of said strip of hot melt adhesive and extending beyond the edge surfaces thereof, a second protective sheet in contact with the opposite surface of said strip of adhesive and extending beyond the edge surfaces thereof and having a length short of the length of said first protective sheet, said second protective sheet having a pressure sensitive adhesive layer thereon to provide attachment thereof to said strip of hot melt adhesive and said first protective sheet to thereby sandwich said strip of hot melt adhesive therebetween, and reinforced tab ends on each of said first and said second sheets to facilitate separation and removal of both said sheets for exposed utilization of said hot melt adhesive strip at the point of use thereof.

2. The article of claim 1 including a third protective sheet adhesively secured to said second protective sheet on the opposite surfaces of and over a length at least the width of said strip of hot melt adhesive.

3. The article of claim 1 wherein said hot melt adhesive is a thermoplastic hot melt adhesive that softens in the temperature range of 280°-325° F. and resolidfies upon cooling.

4. The article of claim 1 wherein said first protective sheet is a polytetrafluoroethylene film.

5. The article of claim 1 wherein said second protective sheet is a thin high temperature resistent single sided pressure sensitive polyimide tape.

6. The article of claim 1 wherein said reinforced tab ends consist of thin layers of polytetrafluoroethylene strips adhesively bonded to the respective protective sheet end segments.

* * * * *